US010729193B2

(12) United States Patent
Massaro

(10) Patent No.: US 10,729,193 B2
(45) Date of Patent: Aug. 4, 2020

(54) NECKTIE HOLDER

(71) Applicant: Thomas Massaro, Wallingford, CT (US)

(72) Inventor: Thomas Massaro, Wallingford, CT (US)

( * ) Notice: Subject to any disclaimer, the term of this patent is extended or adjusted under 35 U.S.C. 154(b) by 182 days.

(21) Appl. No.: 15/737,647

(22) PCT Filed: Jun. 17, 2016

(86) PCT No.: PCT/US2016/038005

§ 371 (c)(1),
(2) Date: Dec. 18, 2017

(87) PCT Pub. No.: WO2016/209723

PCT Pub. Date: Dec. 29, 2016

(65) Prior Publication Data

US 2018/0153236 A1 Jun. 7, 2018

Related U.S. Application Data

(60) Provisional application No. 62/182,498, filed on Jun. 20, 2015, provisional application No. 62/202,896, filed on Aug. 9, 2015.

(51) Int. Cl.

| | |
|---|---|
| ***A41D 25/04*** | (2006.01) |
| ***A41D 25/12*** | (2006.01) |
| ***A41D 25/02*** | (2006.01) |

(52) U.S. Cl.

CPC ..... *A41D 25/02* (2013.01); *A41D 25/022* (2013.01); *A41D 25/025* (2013.01); *A41D 25/027* (2013.01); *A41D 25/04* (2013.01)

(58) Field of Classification Search

CPC ..... A41D 25/02; A41D 25/04; A41D 25/006; A41D 25/008; A41D 25/022;

(Continued)

(56) References Cited

U.S. PATENT DOCUMENTS

| | | | |
|---|---|---|---|
| 1,665,509 | A | 4/1928 | Smith |
| 2,129,657 | A | 3/1938 | Draper |

(Continued)

FOREIGN PATENT DOCUMENTS

| | | |
|---|---|---|
| AU | 197950366 | 3/1980 |
| CH | 613852 | 10/1979 |

(Continued)

*Primary Examiner* — Jameson D Collier

(74) *Attorney, Agent, or Firm* — Cozen O'Connor

(57) ABSTRACT

A necktie holder for securing, around the neck of a wearer, an article of clothing having first and second ends includes: a central portion defining a channel that passes through the necktie holder, the central portion having first and second sides; and first and second wings extending, respectively, from the first and second sides of the central portion. The first and second wings each are arranged with respect to the central portion so that the necktie holder formed by the central portion and the first and second wings is the shape of a knot of a necktie. The channel is configured to permit the first and second ends of the article of clothing to slideably, snugly, and adjustably interact with the channel, whereby the necktie holder can be drawn upwardly over the first and second ends of the article of clothing toward the neck of the wearer.

8 Claims, 4 Drawing Sheets

(58) Field of Classification Search
CPC ..... A41D 25/025; A41D 25/10; A41D 25/12; A41D 25/14; Y10T 24/19; Y10T 24/1962; Y10T 24/1966; Y10T 24/199; A44B 6/00
USPC ..... 2/145, 148, 149, 150, 152.1, 153, 156, 2/137; 24/49.1, 66.2, 66.3, 66.9, 66.11, 24/66.13
See application file for complete search history.

(56) References Cited

U.S. PATENT DOCUMENTS 3,077,606 A 2/1963 Less
3,183,612 A * 5/1965 Romaine ..... A41D 23/00 40/1.5
3,562,815 A * 2/1971 Graham ..... A41D 25/025 2/153
3,584,316 A * 6/1971 Gouner ..... A41D 25/025 2/153
3,958,277 A * 5/1976 Girdler ..... A41D 25/022 2/153
5,864,882 A * 2/1999 Kowalyk ..... A41D 25/10 2/148
5,983,461 A * 11/1999 Chen ..... A41D 25/025 24/115 H
6,094,746 A * 8/2000 Miller ..... A41D 25/10 2/138
6,691,319 B1 * 2/2004 Simon ..... A41D 25/025 2/144
6,920,642 B2 * 7/2005 Dickens ..... A41D 25/022 2/152.1
8,047,580 B2 * 11/2011 Fay ..... D04G 5/00 289/17
2014/0230126 A1 8/2014 Lucero
2016/0135524 A1 * 5/2016 Speer ..... A41D 25/006 2/145

FOREIGN PATENT DOCUMENTS

CN 200941832 9/2007
DE 962061 4/1957
DE 2102874 A1 * 8/1972 ..... A41D 25/025
EP 0672358 9/1995
FR 374142 A * 6/1907 ..... A41D 25/025
WO WO 2010/003427 1/2010

* cited by examiner

NECKTIE HOLDER

PRIORITY CLAIM

This is a U.S. national stage of application No. PCT/US2016/038005, filed on Jun. 17, 2016. Priority is claimed on UNITED STATES, Application No. 62/182,498, filed Jun. 20, 2015; Country and U.S. Application No. 62/202,896, filed Aug. 9, 2015, the contents of which are incorporated here by reference.

BACKGROUND OF THE INVENTION

1. Field of the Invention

The present invention is directed to an article for affixing a necktie or other neckwear around the neck of a wearer without the need for tying a knot.

2. Discussion of Related Art

Neckties, bowties, neck scarves, and the like, form a part of dress ware for men and women. In the case of neckties, for example, wearing a traditional necktie requires that the wearer, or someone willing to assist the wearer, knows how to tie a knot appropriate for a necktie, such as, for example, a "Windsor knot."

However, many people, even people with experience tying such knots, find it difficult to tie the knot correctly. For example, if the lengths of the two ends of the tie are not arranged properly before the tying of the knot has begun, the slimmer end of the tie might end up hanging too low, or too high, in relation to the wider end of the tie. In such instance, it becomes necessary to untie the knot, adjust the relative starting positions of the tie ends, and tie the knot again, possibly having to repeat the process multiple times until the tie ends line up properly once the knot is tied and adjusted around the wearer's collar. Moreover, the act of tying may be difficult for some, such as arthritis sufferers.

Ties that are tied in the traditional manner also may introduce safety issues. For example, a portion of the tie may become hung up in a piece of machinery, or pulled on by, for example, an assailant. Because many knots become tighter as they are pulled, such a predicament can result in a situation in which the wearer of the tie is strangled, and is unable to loosen the knot of the tie so as to escape.

Clip-on ties are known, and do not require the tying of a knot. However, clip-on ties have disadvantages. For one thing, clip-on ties are not securely attached because they do not have a section of the tie arranged around the wearer's neck. Instead, the clip-on tie simply consists of a pre-tied knot with an associated clip for attaching the knot portion of the tie to the front of the wearer's shirt collar, with two downwardly extending pieces of cloth, one in front of the other, hanging down the front of the wearer's shirt. Thus, clip-on ties are subject to being dislodged from the wearer's shirt collar, causing embarrassment to the wearer. Moreover, clip-on ties do not provide the ability of the wearer to perform a fine adjustment of the knot in relation to the collar of the shirt.

Also, many men associate clip-on ties with a time when they were children and are unlikely to wish to be seen wearing such a tie to a business or formal occasion among adults.

Bow ties are similarly difficult to tie. Many men resort to a pre-tied bow with a string that wraps around the neck and clips to a receiving portion on the back of the knot. However, even such pre-tied bow ties require adjustment for fit, which many users find difficult and time consuming.

Thus, there is a need for a device that allows a wearer to have the appearance of a neatly created tie knot without the difficulty of tying one of the complicated knots conventionally relied upon for this purpose and without the difficulty of making fine adjustments to the positioning of the tie in relation to the shirt collar. There is also a need for a device that provides a safer mechanism for wearing a tie, without the use of a knot, which can cause strangulation if subject to pulling on the tie.

SUMMARY OF THE INVENTION

The present invention solves the above-mentioned problems of the prior art by providing an article that is configured in a shape similar to that of the knot of a necktie, and which includes an interior passageway that interacts with and slidably, yet securely and snugly, receives the two end portions of the necktie, scarf, or similar article of apparel, so as to provide the appearance of the user wearing a necktie or related neckwear. In another embodiment, an article is provided that allows a bow tie to be simulated, without the requirement of tying a bow tie knot or making difficult adjustments to properly tighten the bow tie.

In accordance with a first aspect of the invention, a necktie holder for securing, around the neck of a wearer, an article of clothing having first and second ends includes: a central portion defining a channel that passes through a vertical extent of the necktie holder, the central portion having first and second sides; and first and second wings extending, respectively, from the first and second sides of the central portion. The first and second wings each are arranged with respect to the central portion so that the necktie holder formed by the central portion and the first and second wings is the shape of a knot of a necktie. The channel is configured and dimensioned so as to permit the first and second ends of the article of clothing to slideably, snugly, and adjustably interact with the channel, whereby the necktie holder can be drawn upwardly over the first and second ends of the article of clothing toward the neck of the wearer.

In another aspect, the necktie holder further includes a tubular member defining a bottom portion of the channel as an enclosed channel.

In another aspect, the first and second wings each taper upwardly.

In another aspect, the channel is configured such that the first and second ends of the article of clothing are received at a top portion of the channel and extend out of the channel at a bottom portion of the channel.

In another aspect, the central portion is integrally formed with the first and second wings.

In another aspect, the necktie holder is integrally formed from the group consisting of: cast iron, aluminum, precious metals (gold, silver, etc.), injection molded high-density polyethylene (HDPE), 3D-printed chlorinated polyethylene (CPE) elastomer, 3D-printed acrylonitrile butadiene styrene (ABS) plastic and polylactic acid (PLA).

In another aspect, the channel is oval in cross-section.

In another aspect, the channel is non-circular in cross-section.

In another aspect, the first and second wings taper in a rearward direction relative to the central portion.

In another aspect, the necktie holder further includes a decoration applied to a front surface of the necktie holder.

In accordance with another aspect of the present invention, a bow tie includes: first and second necktie holders as described hereinabove; and a tubular connector having a first connector end and a second connector end, each of the first connector end and the second connector end being configured to slideably engage with a respective channel of the first and second necktie holders so as to form, upon assembly of the tubular connector and the first and second necktie holders: a bow tie channel extending over a longitudinal extent of the bow tie, and first and second bow tie openings at respective ends of the assembled bow tie.

In another aspect, the bow tie further includes a string, arranged through the bow tie channel and out the first and second bow tie openings, the string having a length sufficient to permit the bow tie to be tied around the neck of the user.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
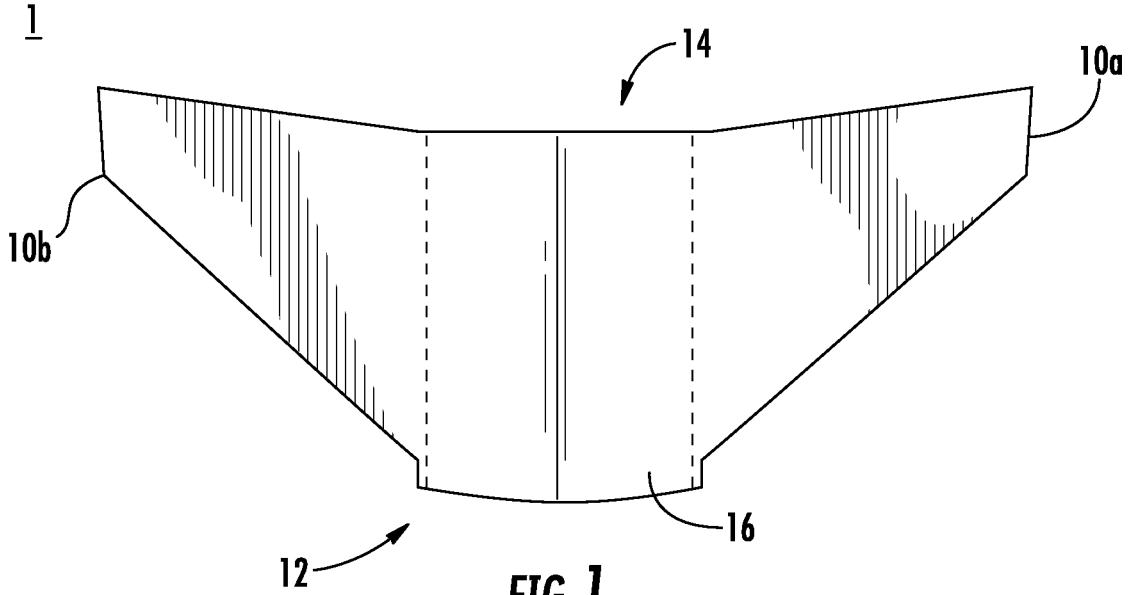
FIG. 1 is a front elevation view of a necktie holder in accordance with one embodiment of the present invention.
Figure 2:
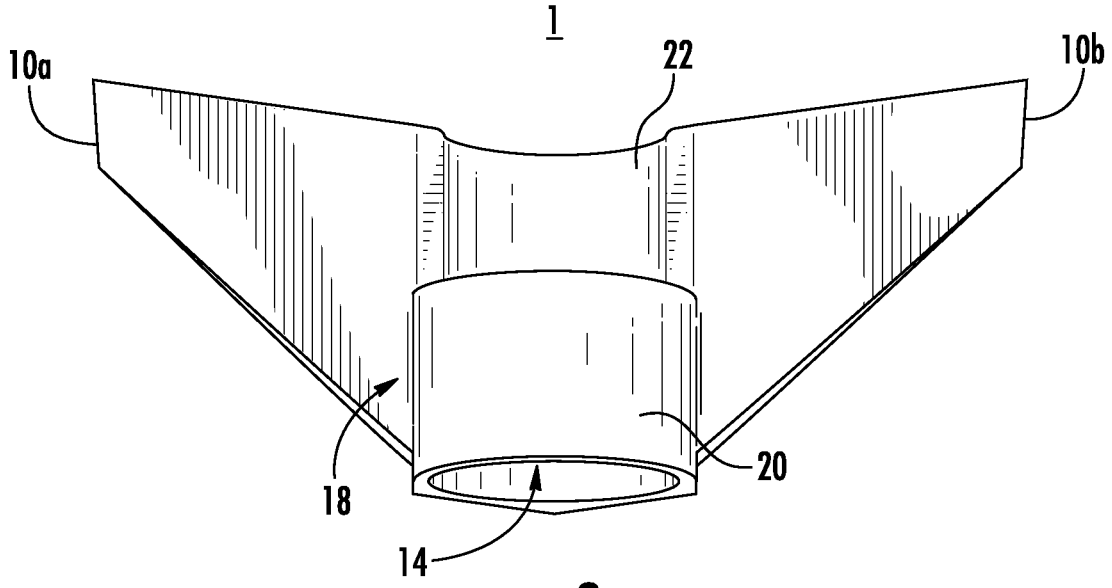
FIG. 2 is a rear elevation view of the necktie holder of FIG. 1.
Figure 3:
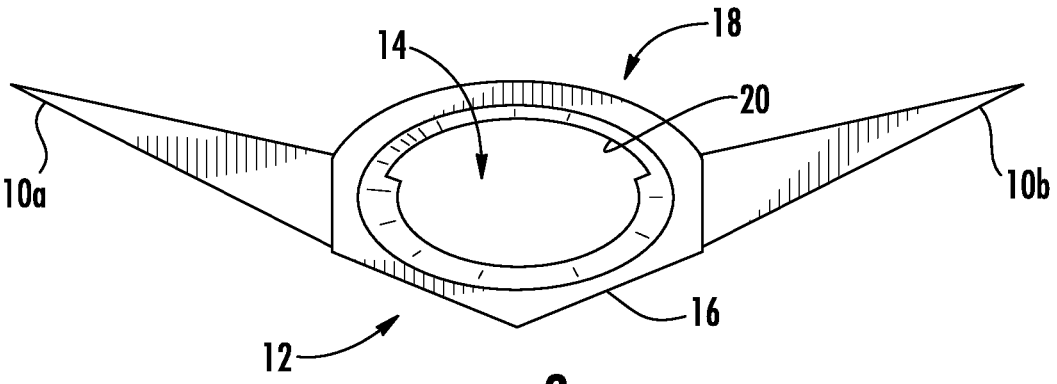
FIG. 3 is a bottom view of the necktie holder of FIG. 1.

Referring to FIGS. 1-3, a necktie holder 1 in a preferred embodiment has dual wings 10*a* and 10*b* protruding from a central portion 12. The central portion 12 is formed so as to define a channel 14 that allows slideable, and adjustable, engagement of the necktie holder 1 with, for example, end pieces of a necktie. As can be seen, for example, in FIGS. 1-3, the necktie holder 1 is configured generally in the shape of a necktie knot, that is, it has an overall shape, seen from the front, tapering from a narrower portion at the bottom to a wider portion near the top, as would be typical of a customarily tied necktie knot.

The channel 14 is configured so as to permit two ends of a neck tie, or other clothing article, to pass through the channel 14. As will be discussed in greater detail below, the cross-section of the channel 14 is shaped and dimensioned to best permit a fit of the tie within the channel 14 that is snug enough to securely hold the necktie holder 1 on the tie at the location of the collar of the wearer's shirt, while still permitting the ends of the necktie to be removed, or adjusted, if the necktie holder 1 and the necktie ends are manipulated by the wearer, or another person.

As can be seen, for example, in FIG. 3, the wings 10*a* and 10*b* are configured so as to extend back obliquely with respect to the longitudinal extent of the necktie holder 1. That is, the wings 10*a* and 10*b* taper back, towards the wearer, when worn. The wings 10*a* and 10*b* also taper upwardly, to simulate, to someone looking at the wearer, the shape a neck tie knot, which is narrower at the bottom than at the top.

The central portion 12 of the necktie holder 1 is preferably integrally formed with the wings 10*a* and 10*b*. The central portion 12 has a front surface 16 and a back surface 18. The central portion 12 is also configured so as to define a channel 14 extending over the vertical extent of the necktie holder 1. The channel 14 is fully enclosed over a portion of its extent, namely at the bottom portion, i.e., towards the feet of the wearer when worn by the user, by a tubular member 20 positioned at the bottom of the necktie holder 1, in the manner illustrated in FIG. 2. The tubular member 20 has a top edge and a bottom edge, wherein the bottom edge defines a bottom-most point of the necktie holder 1.

Above the tubular member 20, the channel 14 continues, but now consists of only a half-channel 22 with an arcuate inner contour formed as an indentation in the back surface 18, which is a continuation of the part of the channel 14 formed in the front side, away from the wearer. The central portion 12 is formed so that the tubular member 20, and the changeover from the fully enclosed channel 14 to the half-channel 22, are not visible to the observer when the necktie holder is worn with a tie.

Maintaining the tubular member 20 over only the lower portion of the vertical extent of the necktie holder 1 permits the ends of the tie to be more easily initially fit into the channel 14. This provides for easier installation of the ends of the tie into the necktie holder 1.

Although the profile of the front 16 in the illustrative embodiment shown in FIG. 3 comes to a point, in cross-section, at its apex facing away from the wearer, the invention is in no way limited to this front profile. The front apex profile can instead be rounded, or have, for example, a flattened portion at the apex.

Preferably the cross-section profile of the channel 14 is that of a non-circular oval having the longer portion of the oval oriented in the direction of longitudinal extension of the necktie holder 1. The inventor has found that such an oval shape provides for a secure, snug fit, while permitting both ends of a conventional necktie to be pulled through the channel 14 when donning the tie, removing the tie, or adjusting the tie.

Figure 4:
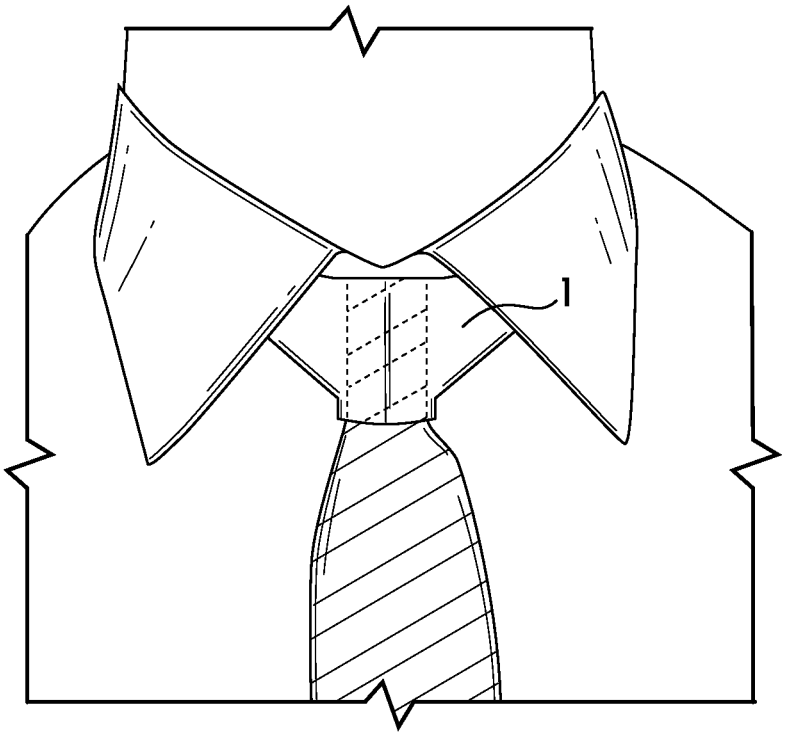
FIG. 4 is a view showing the necktie holder of FIG. 1 securing a necktie around the neck of a wearer.

FIG. 4 shows the necktie holder 1 in use with a conventional necktie. In order to use the necktie holder 1, the tie is folded and its ends are fed into the channel 14 and through the oval hole of tubular member 22, keeping the front of the tie in the same direction with the front of the necktie holder 1. The tie is then pulled through just enough to still permit the tie to slip over the wearer's head. Once over the wearer's head, the position of the necktie holder 1 is adjusted under the collar and pulled tight like a traditional tie to the wearer's satisfaction. The action is quick and easy, typically taking just a few seconds. In the case of a conventional necktie, the process would typically be completed by tucking the narrower back end of the tie into the loop that is typically sewn into the back of the wider front end of the tie, to keep the two ends of the tie from moving independently of one another while the tie is being worn.

As can be seen in FIG. 4, both the wider and narrower ends of the tie have been pulled down through the channel 14 and are, at the location near the front collar of the wearer's shirt, snugly, yet adjustably, maintained within the channel 14. From this position, the wearer can easily slide the necktie holder slightly up or down for maximum comfort and fashion. To remove the tie, the wearer simply pulls and slides the necktie holder 1 completely down and off of the ends of the tie. This obviates the need for untying a knot, as would be necessary to completely remove, and for example, re-hang in the closet, a traditionally employed tie using a knot. The ability to slidably disengage the tie using the necktie holder 1 in place of a knot also provides a safety function. That is, even if the tie is pulled, or becomes entangled, rather than strangle the wearer, the tie will simply slip out of the necktie holder 1.

Optionally, the necktie holder 1 can be slid down only as far as necessary for the tie to be slipped over the head of the wearer, leaving portions of the ends of the tie still in the channel 14. This option has the advantage of not having to feed the ends of the tie back into the channel 14 to use the tie again.

As shown above, the necktie holder 1 in effect, both in utilitarian function and in aesthetic function, replaces the knot of a tie.

Preferably, the necktie holder 1 is formed integrally as one piece with no moving parts. The necktie holder is preferably formed of cast iron, aluminum, precious metals (gold, silver, etc.), injection molded high-density polyethylene (HDPE), 3D-printed chlorinated polyethylene (CPE) elastomer, 3D-printed acrylonitrile butadiene styrene (ABS) plastic or polylactic acid (PLA). Of course, the invention is not limited to the use of such materials or processes.

Figure 5:
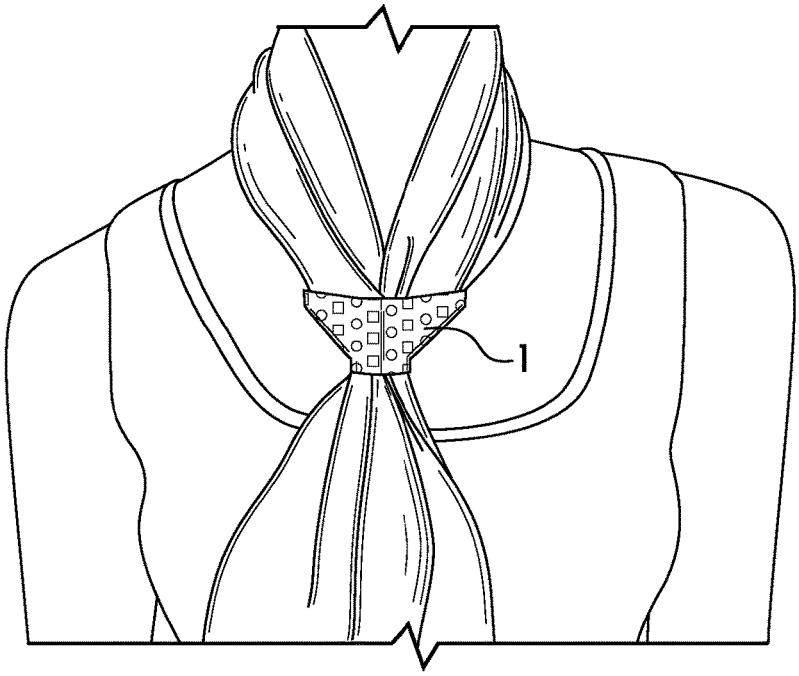
FIG. 5 is a view showing the necktie holder securing a scarf around the neck of a wearer.

The outer face of the necktie holder 1 can preferably have or support a design that simulates, blends in, contrasts, or enhances with the color, pattern and/or texture of the material of the necktie. This can be achieved by covering the front facing side of the necktie holder 1 with, for example, fabric or leather, or by painting or application of an adhesive printed decal having the desired design to match the tie or by molding the device with such an enhancement or pattern. FIG. 5, discussed further below, illustrates an example of a necktie holder 1 with such a decorative pattern.

The size of the necktie holder 1 is not limited to any particular size, but may come, for example, in various sizes, to accommodate the fashion trends of the day, for example, narrower ties or wider ties. A large necktie holder 1 could have, for example, a width of approximately 3.25 inches wide and a height of approximately 1.9 inches high. A medium necktie holder could have, for example, a width of approximately 2.7 inches wide and a height of approximately 1.9 inches high. A small necktie holder could have, for example, a width of approximately 1.3 inches wide and a height of approximately 1.9 inches high.

FIG. 5 shows the necktie holder 1 used with a scarf, for example a woman's scarf. Just as in the case of using the necktie holder 1 with a necktie, the scarf is put on by pulling two ends through the oval channel 14, and at the same time sliding the necktie holder 1 upwardly toward the neck of the wearer until a desired fit is achieved. As mentioned above, in FIG. 5, the necktie holder 1 has a decorative design.

Figure 6:
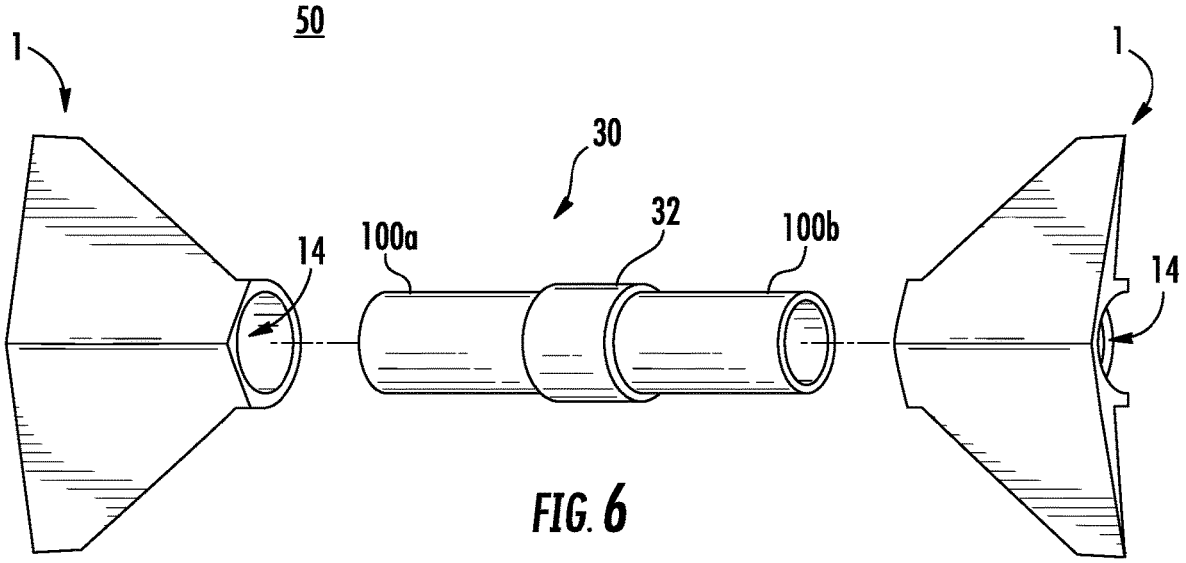
FIG. 6 is an exploded view of an embodiment configured for use as a bow tie knot.
Figure 7:
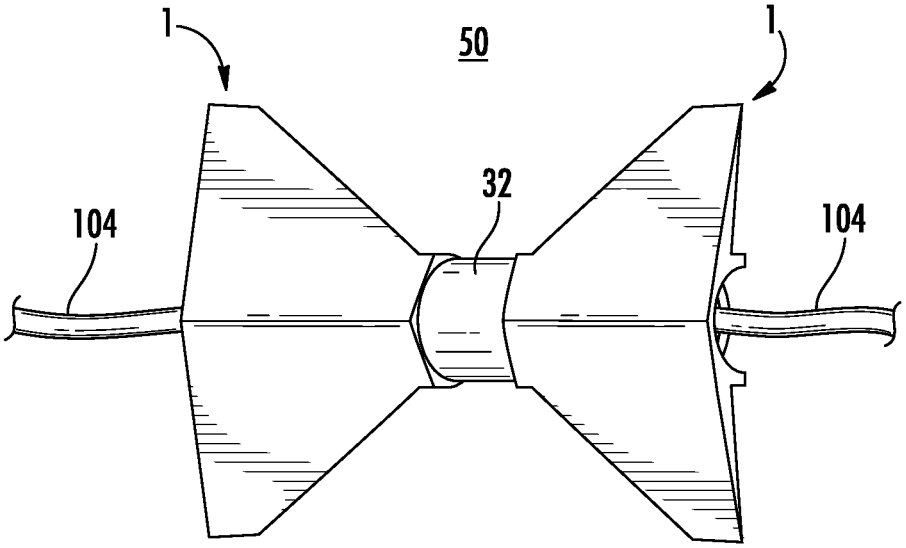
FIG. 7 is a view showing the embodiment of FIG. 6 in its assembled state.

FIG. 6 is an exploded view of a use of the two necktie holders 1, as described above, together with a tubular connecting member 30, having a raised central area 32, to form, when assembled, configuration of a bow tie 50. The tubular connecting member 30 is configured so that its outer end portions 100*a* and 100*b* are dimensioned to friction fit engage the channels 14, and in particular the tubular members 22, of each of the two outer necktie holders 1, as shown in the view of the assembled bow tie in FIG. 7. To permit the outer end portions 100*a* and 100*b* to fit slidably into the respective channels 14, the tubular connecting member 30 has an oval cross-section corresponding to that of the respective channels 14, and in particular the respective tubular members 22 of the two necktie holders 1.

The bow tie 50 preferably, once assembled, uses a string 104, which passes through the entire bow tie 50. The string 104 preferably can be clasped around the user's neck, with, for example, an adjustment mechanism to provide a snug fit.

While preferred embodiments of the present invention have been shown and described, it will be understood by those skilled in the art that various changes and modifications could be made without varying from the scope of the present invention.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A necktie holder for securing, around the neck of a wearer, an article of clothing having first and second ends, the necktie holder comprising:

a central portion having a front surface, a back surface, a bottom portion, a top portion, and first and second sides, the front and back surfaces extending between the bottom portion and the top portion, the central portion defining a continuously closed channel positioned on the back surface, the closed channel having a bottom edge proximate the bottom portion the bottom edge defining a bottom-most point of the necktie holder, and a top edge distally spaced from the top portion, wherein a portion of the back surface of the central portion between the top edge of the closed channel and the top portion comprises an open channel formed as an indentation in the back surface; and first and second wings attached to the central portion and extending, respectively, from the first and second sides of the central portion, wherein the necktie holder is configured such that the article of clothing interacts with the channel defined by the central portion, the closed channel being configured and dimensioned so as to permit the first and second ends of the article of clothing to slidably, snugly, and adjustably interact with the closed channel, whereby the necktie holder can be drawn upwardly over the first and second ends of the article of clothing toward the neck of the wearer, and wherein the closed channel is configured such that the first and second ends of the article of clothing are receivable at edge portion of the closed channel and extend out of the edge portion of the closed channel.

2. The necktie holder according to claim 1, wherein the first and second wings each taper upwardly.

3. The necktie holder according to claim 1, wherein the central portion is integrally formed with the first and second wings.

4. The necktie holder according to claim 3, wherein the necktie holder is integrally formed from a material selected from the group consisting of: cast iron, aluminum, precious metals, injection molded high-density polyethylene (HDPE), 3D-printed chlorinated Polyethylene (CPE) elastomer, 3D-printed acrylonitrile butadiene styrene (ABS) plastic and polylactic acid (PLA).

5. The necktie holder according to claim 1, wherein the closed channel is oval in cross-section.

6. The necktie holder according to claim 1, wherein the closed channel is non-circular in cross-section.

7. The necktie holder according to claim 1, wherein the first and second wings taper in a rearward direction relative to the central portion.

8. The necktie holder according to claim 1, further comprising a decoration supported on the front surface.

* * * * *